United States Patent [19]

Kaiser et al.

[11] 4,162,729

[45] Jul. 31, 1979

[54] PROTECTIVE PACKAGING DEVICE

[75] Inventors: Louis Kaiser, Orange; Charles J. Pascal, Newtown, both of Conn.

[73] Assignee: Uniroyal, Inc., New York, N.Y.

[21] Appl. No.: 842,643

[22] Filed: Oct. 17, 1977

[51] Int. Cl.[2] ..... B65D 5/42; B65D 85/30

[52] U.S. Cl. ..... 206/592; 206/453; 206/586; 229/DIG. 1

[58] Field of Search ..... 229/14 C, 23 AB, 23 BT, 229/87 R, DIG. 1, DIG. 3; 206/449, 450, 451, 453, 454, 586, 588, 591, 592, 593, 594

[56] References Cited

U.S. PATENT DOCUMENTS

| | | | |
|---|---|---|---|
| 1,998,515 | 4/1935 | Miller | 229/DIG. 1 |
| 2,509,468 | 5/1950 | Anderson, Jr. | 206/453 |
| 2,514,833 | 7/1950 | Bergeron | 229/DIG. 1 |
| 2,631,723 | 3/1953 | Ellsworth | 206/453 |
| 2,670,122 | 2/1954 | Davidson et al. | 206/586 |
| 2,896,833 | 7/1959 | Markham | 229/14 C |
| 3,061,166 | 10/1962 | Deeren et al. | 229/14 C |
| 3,063,613 | 11/1962 | McClive | 229/14 C |
| 3,081,018 | 3/1963 | Hall | 229/DIG. 3 |
| 3,349,984 | 10/1967 | Halko, Jr. | 206/453 |

FOREIGN PATENT DOCUMENTS

| | | | |
|---|---|---|---|
| 1135813 | 5/1957 | France | 229/14 C |

*Primary Examiner*—Herbert F. Ross
*Attorney, Agent, or Firm*—Philip Rodman

[57] ABSTRACT

The protective package device, which can be varied in size to accommodate articles within a given dimensional range, includes a plurality of insert members, and a given number of corner sleeve members corresponding to the number of corners of the article being enclosed.

An insert member when folded in one fashion engages straight sides of the article, and when folded in another fashion engages a corner portion of the article. The corner sleeve members are installed after the insert members are engaged with the article and are sized to overlap each other when installed on articles within the given dimensional range. The corner sleeve members can thus telescopically expand or contract to different package sizes determined by the enclosed article.

17 Claims, 15 Drawing Figures

20
22
24
26
28
30
32
34
36
38
40
42
64
66
68
70
72
74
76
80
82
84
86
89
108
110
112
114
136
138
140
142
9
10

Fig.11.
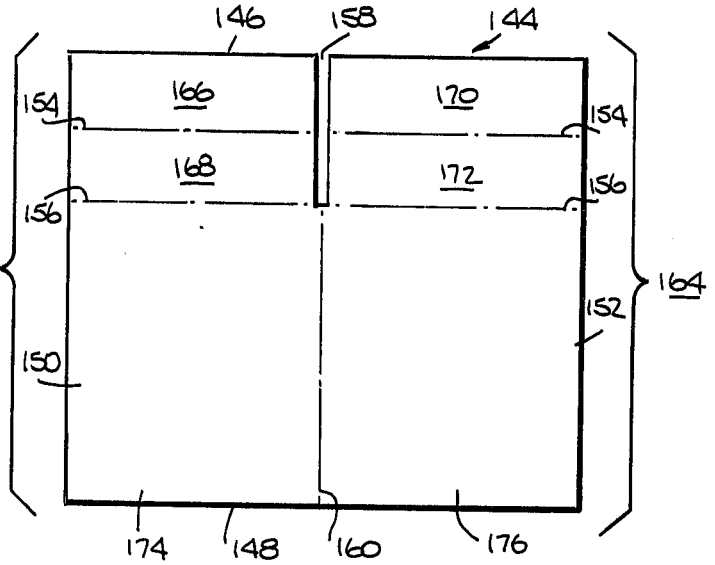
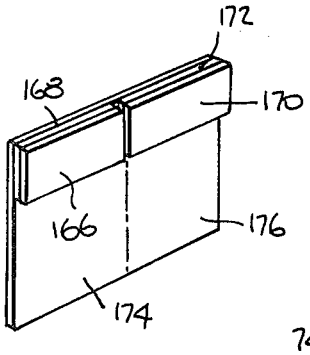
Fig.12.
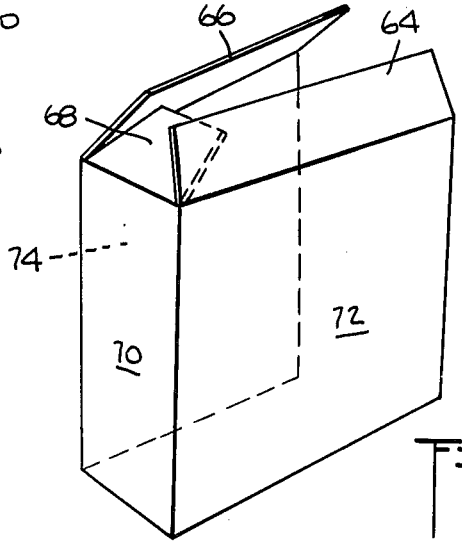
Fig.15.
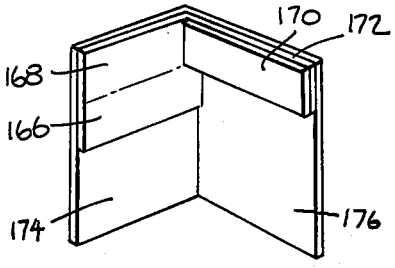
Fig.13.
Fig.14.
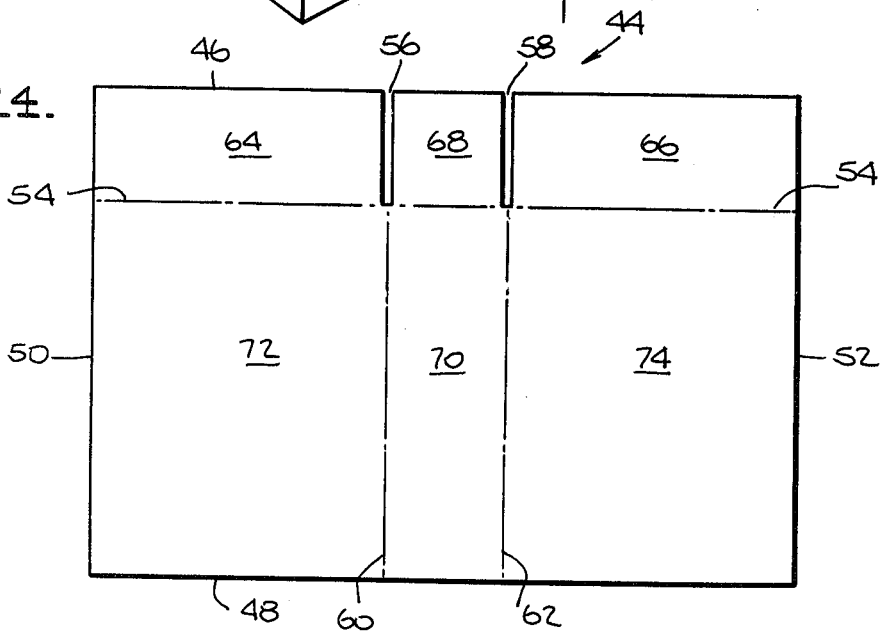

PROTECTIVE PACKAGING DEVICE

This invention is directed to containers for fragile articles and more particularly to a telescoping protective package that accommodates fragile articles of various size.

One known way of packing relatively large fragile articles for shipment is to enclose them in non-fragile rigid containers such as wood crates for example. The rigid container can include any suitable known shock absorbing packing material to minimize the risk of article breakage should the container be subject to rough handling or bouncy shipping conditions. Oftentimes the container weighs more than the article being shipped and thereby significantly affects the cost of such shipment. It is thus desirable to minimize the size and weight of the shipping container without jeopardizing the safety of the enclosed article.

Ordinarily articles of different size require different sized containers. If shipping container inventories do not keep pace with the volume of different sized articles ready to be shipped an article may be delayed while waiting for a proper sized container, or it may be shipped at excessive cost in an oversized container.

It is thus desirable to provide a universal light weight shock absorbing container which can be expanded or contracted to enclose articles of various size.

Among the several objects of the present invention may be noted the provision of a novel protective packaging device for fragile articles, a novel telescoping protective package adaptable for use with articles of various size, a novel packaging device formed from a plurality of separable telescoping package members, novel packaging components for a packaging device, and a novel protective packaging device including novel protective inserts that engage straight sides or corners of an enclosed article.

Other objects and features will be in part apparent and in part pointed out hereinafter.

The present invention relates to a novel protective packaging device that can be varied in size to accomodate articles within a given dimensional range. The packaging device, in a preferred embodiment, includes a plurality of corner sleeve members each of which is engageable with a respective corner portion of an article, such as an illuminating plastic sign in the general shape of a parallelepiped. The sign includes a metal frame and a translucent facing stepped away from the frame. The corner sleeve members, at each corner portion of the article, are arranged to telescopically overlap by an amount determined by the size of the article being enclosed.

The packaging device also includes a plurality of insert members which fold in one of two desired fashions to fit onto the straight sides or the corners of the article prior to installation of the corner sleeve members. The packaging inserts engage the step portion on the sign and protrude beyond the translucent facing to maintain a clearance space between the corner sleeve members and the translucent facing.

The invention accordingly comprises the constructions hereinafter described, the scope of the invention being indicated in the following claims.

In the accompanying drawings in which various possible embodiments of the invention are illustrated:

Figures 1, 2, 3:
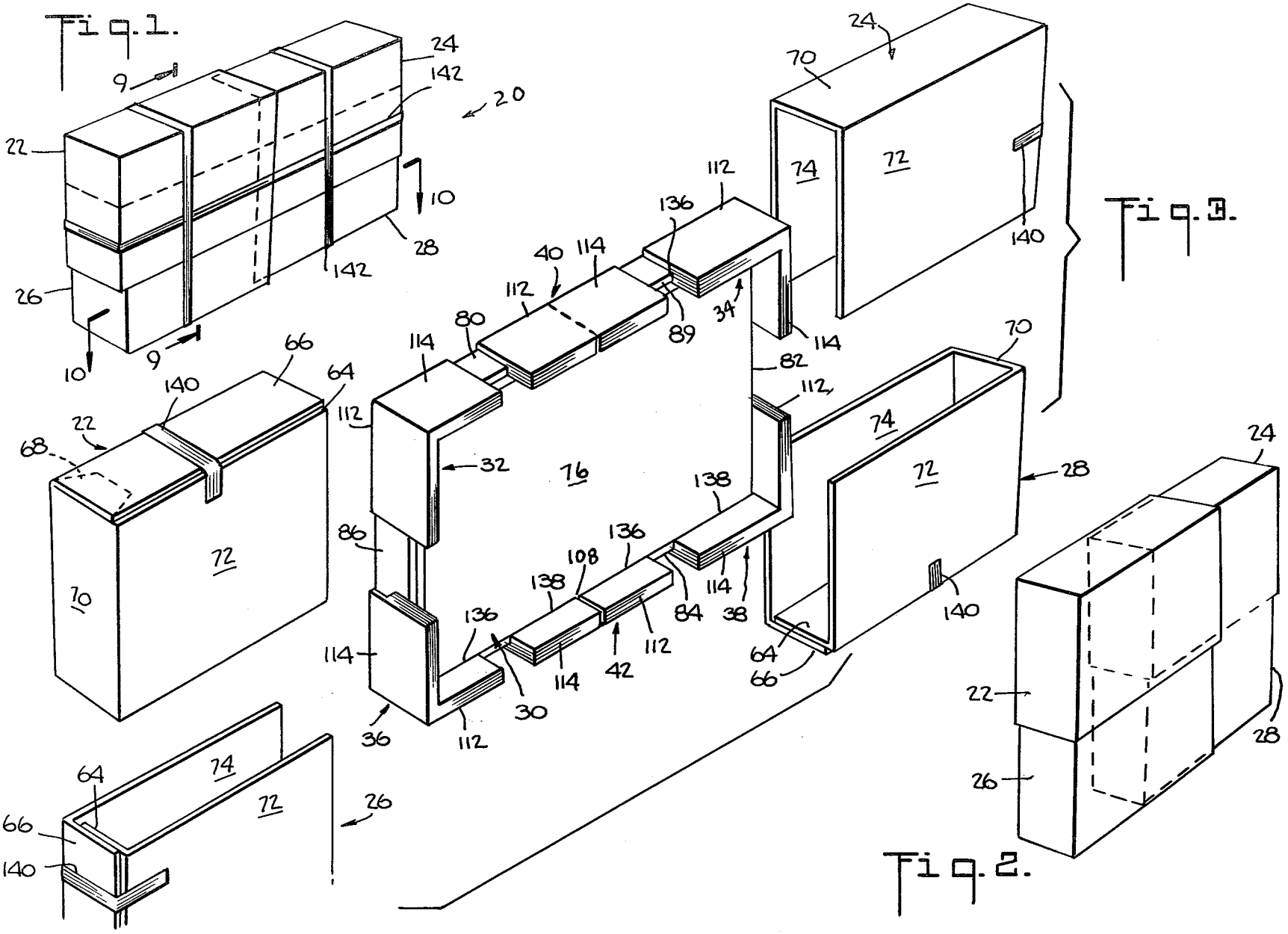
FIG. 1 is a perspective view of the packaging assembly.
FIG. 2 is a view similar to FIG. 1 showing the packaging assembly components arranged to form a package size different from that of FIG. 1.
FIG. 3 is a partially exploded perspective view thereof.
Figure 9:
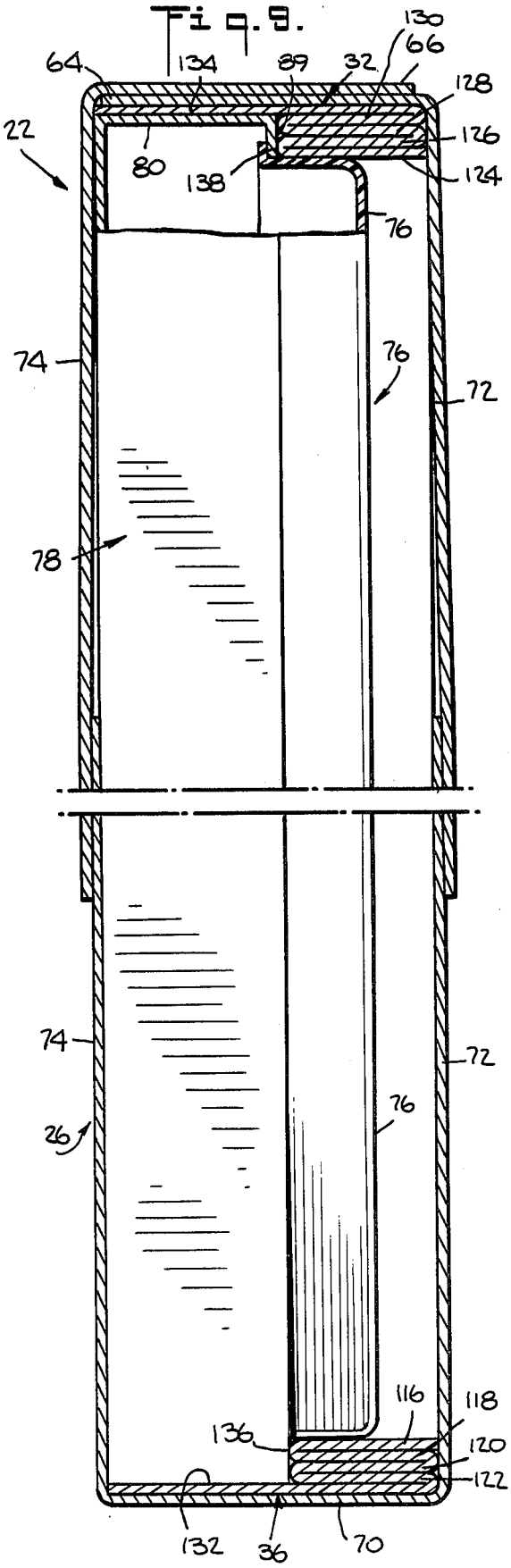
Figure 10:
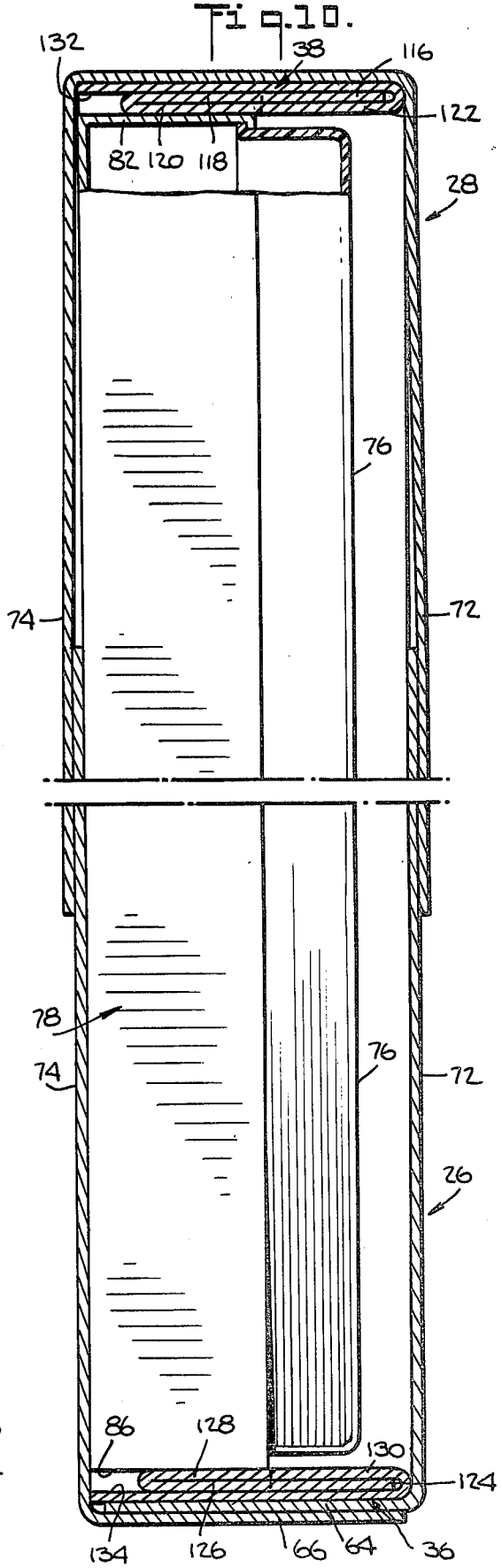

FIGS. 9 and 10 are sectional views taken along lines 9—9 and 10—10 of FIG. 1;

FIG. 11 shows another embodiment, in development, of the inner packaging component;

FIGS. 12 and 13 show the development of FIG. 11 in different folded positions;

FIG. 14 is a development of the outer corner sleeve member; and,

FIG. 15 shows the development of FIG. 14 being folded.

Corresponding reference characters indicate corresponding parts throughout the several views of the drawings.

Referring to the drawings a protective packaging device is generally indicated by reference number 20 in FIG. 1. The packaging device 20 includes a plurality of corner sleeve members 22, 24, 26 and 28 arranged on an article 30 after a plurality of packaging insert members 32, 34, 36, 38, 40 and 42 have been installed around the article 30.

The corner sleeve members 22, 24, 26 and 28 are formed of any suitable flexible foldable material such as 275 lb. test C-flute, single-wall corrugated material. A generally rectangular development 44 (FIG. 14) shows the corrugated sheet pattern used in making a typical corner sleeve member 22, 24, 26 or 28.

The development 44 includes upper and lower edges 46 and 48, and opposite side edges 50 and 52. A first score-line 54 extends across the opposite side edges 50 and 52 a predetermined distance from upper edge 46. A pair of median cut portions 56 and 58 extend from the scoreline 54 substantially perpendicular to the upper edge 46. Median scorelines 60 and 62 respectively extend from the cut portions 56 and 58 substantially perpendicular to the lower edge 48.

A side portion flap 64 in the development 44 is bounded by the upper edge 46, the cut portion 56, the scoreline 54 and the side edge 50. Another side portion flap 66, substantially equivalent to the leaf 64, is bounded by the upper edge 46, the side edge 52, the score-line 54 and the cut portion 58. A median flap 68 is bounded by the upper edge 46, the cut portions 56, 58 and the scoreline 54. A side portion 70 is bounded by the scorelines 54, 60, 62 and the lower edge 48. A web portion 72 is bounded by the side edge 50, the scorelines 54, 60 and the lower edge 48. Another web portion 74 is bounded by the scorelines 62, 54, the side edge 52 and the lower edge 48.

The development 44 is folded at the scorelines 54, 60 and 62 in the manner indicated in FIG. 15. The median flap 68 is folded towards the side portion 70 and the web portion 72 and 74 are brought into opposite confronting positions with the side portion flaps 64 and 66 folded over one another in any selected order. The resulting folded corner sleeve is typical of the sleeves 22, 24, 26 and 28 as shown in FIGS. 1–3.

The article 30 is, for example, a hollow illuminating sign in the general shape of a parallelepiped. The sign 30 contains suitable light sources such as fluorescent light tubes or incandescent bulbs (not shown) and includes a translucent facing 76 such as for example formed of Plexiglas plastic sheet material secured to a metal frame 78 in any suitable known manner. The frame 78, which can be formed of aluminum, includes peripheral sides 80, 82, 84 and 86. A step 89 is provided between the facing 76 and the sides 80, 82, 84 and 86 of the frame 78. Preferably the step 89 is more pronounced at the sides 80 and 84 than at the sides 82 and 86, as most clearly shown in FIGS. 9 and 10.

Figure 5:
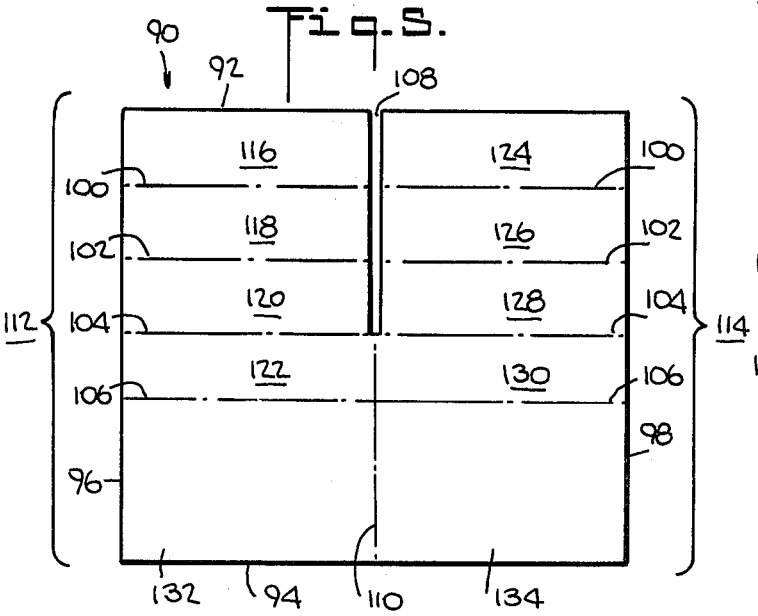
FIG. 5 shows a development of the inner packaging component.

The insert members 32, 34, 36, 38, 40 and 42 are formed of any suitable flexible foldable material such as 275 lb. test B-C flute, double-wall corrugated material. A generally rectangular development 90 (FIG. 5) shows the corrugated sheet pattern used in making a typical insert member 32, 34, 36, 38, 40 or 42.

The development 90 includes upper and lower edges 92 and 94, and opposite side edges 96 and 98. Respective scorelines 100, 102, 104 and 106 extend across the opposite side edges 96 and 98. An intermediate cut portion 108 extends substantially perpendicularly from the upper edge 92 to the scoreline 104, and a panel scoreline 110 extends from the cut portion 108 perpendicular to the lower edge 94.

A panel 112 of the development 90 is bounded by the upper edge 92, the cut portion 108, the panel score-line 110, the lower edge 94, and the side edge 96. Another panel 114 is bounded by the upper edge 92, the side edge 98, the lower edge 94, the panel scoreline 110 and the cut portion 108. The scorelines 100, 102, 104, 106, 110 and the cut portion 108 define substantially equal foldable portions 116, 118, 120 and 122 on the panel 112, and substantially equal foldable portions 124, 126, 128 and 130 on the panel 114.

Although not shown the scorelines 100 and 104 are slit on one surface of the development 90 whereas the scorelines 102 and 106 are slit on the reverse surface thereof to facilitate folding of the foldable portions 116–130 in accordion fashion.

A tail portion 132 on the panel 112 is bounded by the scorelines 122, 110, the lower edge 94 and the side edge 96. Another tail portion 134 on the panel 114 is bounded by the scorelines 110, 106, the side edge 98 and the lower edge 94.

Figure 6:
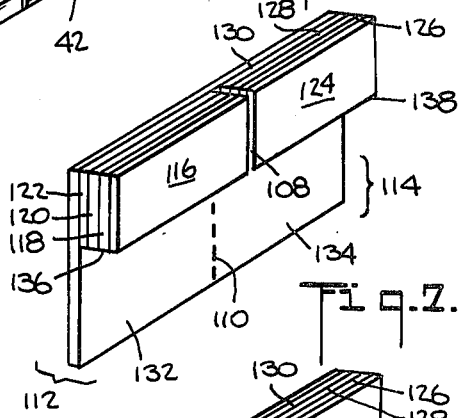
FIGS. 6, 7 and 8 show the inner packaging component in various folded positions.

The development 90 is folded to form the accordion configuration of FIG. 6 by placing the foldable portions 116, 124 against the foldable portions 118, 126. The foldable portions 118, 126 are then placed against the foldable portions 120, 128 on the reverse surface of the development 90. The foldable portions 120, 128 are folded against the foldable portions 122, 130 on the obverse surface of the development 90 and the foldable portions 122, 130 are folded against the tail portions 132, 134 on the reverse surface of the development 90. In this manner a step 136 is defined on the panel 112 and a step 138 is defined on the panel 114. The resulting arrangement is typical of the inserts 40 or 42.

Figure 7:
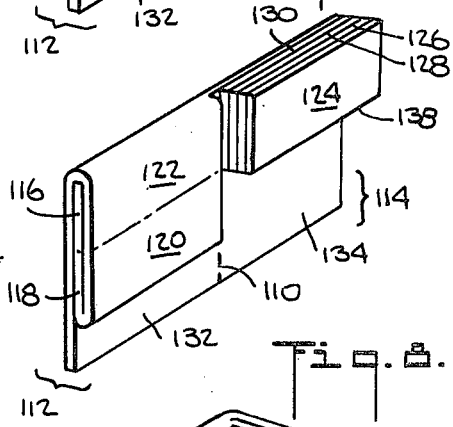
Figure 8:
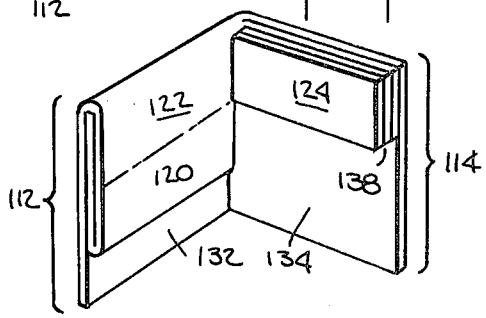

The FIG. 8 configuration is obtained by, for example, rearranging the FIG. 6 configuration in the manner shown in FIG. 7. That is, the panel 114 shown in FIG. 6 is left as is and the panel 112 is extended to permit the foldable portions 116 and 118 to be sandwiched between the foldable portions 120, 122 and the tail portion 132. The development 90 is then folded along the scoreline 110. It should be noted that the panels 112 and 114 may rip slightly at the scoreline 102 during such folding but this rip is tolerable since the insert is not reused. The resulting arrangement is typical of the inserts 32 and 38.

The inserts 34 and 36 are mirror images of the inserts 32 and 38. Therefore the FIG. 6 configuration is rearranged by leaving the panel 112 as is and extending the panel 114 to permit the foldable portions 124 and 126 to be sandwiched between the foldable portions 128, 130 and the tail portion 134. The development 90 is then folded along the scoreline 110. A slight ripping may also occur at the scoreline 102 during such folding.

In using the protective packaging device 20, the insert members 32, 34, 36 and 38 are installed at the corners of the sign 30. The step portion 138 of the insert member 38 engages the step 89 between the frame side 84 and the translucent facing 76, and the tail portion 134 bears against the frame side 84. The folded panel 112 of the corner insert member 38 bears against the frame side 82. The step portion 136 of the corner insert member 36 engages the step 89 at the frame side 84, and the folded panel 114 bears against the frame side 86. Similarly the step portions 138 and 136 of the respective corner insert members 32 and 34 engage the step 89 at the frame side 80. Also the folded panels 112 and 114 of the respective corner insert members 32 and 34 bear against the respective frame sides 86 and 82.

The step portions 136 and 138 of the insert member 40 engage the step 89 of the frame side 80 intermediate the insert members 32 and 34. The tail portions 132, 134 of the insert member 40 bear against the frame side 80. Similarly the insert member 42 is positioned between the insert members 36 and 38 with the step portions 136 and 138 in engagement with the step 89 at frame side 84, and the tail portions 132, 134 bear against the frame side 84.

The insert members 32, 34, 36, 38, 40 and 42 project beyond the translucent facing a predetermined amount and, if desired, can be taped (not shown) or otherwise temporarily secured to the frame sides 80, 82, 84 and 86.

The corner sleeve members 22, 24, 26 and 28 are then installed at the respective corners of the sign 30. For example, referring to FIG. 3, the corner sleeve member 28 is first installed over the insert member 38, and the side portion flaps 64 and 66 are taped or otherwise secured together such as with a tape 140. The corner sleeve member 24 is next installed over the insert member 34 and its side portion flaps 64–66 are secured together. The corner sleeve members are sized to permit the side portions 64–66 and the web portions 72, 74 of the corner sleeve 24 to overlap the respective side portion 70 and the web portions 72, 74 of the corner sleeve member 28 as shown in FIGS. 1 and 2. Preferably the side portion flaps 64–66 of the corner sleeve member 24 are taped after said member is installed.

The corner sleeve member 26 is then installed over the insert member 36. The side portion 70 (not shown) of the corner sleeve member 26 overlaps the side portions 64–66 of the corner sleeve member 28. The flexibility and deformability of the corrugated material constituting the corner sleeve members enables the side portion 70, and web portions 72, 74 of the corner sleeve member 26 to distort slightly in order to fit over the side portions 64–66 and web portions 72, 74 of the previously installed corner sleeve member 28. The web portions 72 and 74 of the corner sleeve member 26 overlap the web portions 72 and 74 of the corner sleeve members 24 and 28.

Lastly the corner sleeve member 22 is installed over the insert member 32 with the side portion 70 overlapping the side portions 64–66 of the corner sleeve member 26. The side portions 64–66 of the corner sleeve member 22 overlap the side portion 70 of the corner sleeve member 24. The web portions 72 and 74 of the corner sleeve member 22 overlap the web portions 72 and 74 of the previously installed corner sleeve members 28, 24 and 26.

It should be noted that the corner sleeve members 22, 24, 26 and 28 can be installed on the sign 30 in any selected order with the side portion flaps 64–66 of one corner sleeve member overlapping either the side portion flaps 64–66 or the side portion 70 of another corner sleeve member. It is also feasible to have an arrangement wherein the side portion 70 of one corner sleeve member overlaps either the side portion flap 70 or the side portion flaps 64–66 of a previously installed corner sleeve member due to the flexibility and distortability of the cardboard material constituting the corner sleeve members. The flexibility and distortability of the cardboard material also enables the installed corner sleeve members to telescope with respect to each other to assume the smallest possible package size around the insert members 32–42 and the sign 30.

The overlapping portions of the corner sleeve members 22–28 insure that the sign 30 is fully enclosed.

After the corner sleeve members 22–28 have been telescoped to the smallest possible package size corresponding to the enclosed sign 30, strips of tape 142 can be applied to the exterior of the package to secure the corner sleeve members together.

Since the insert members 32–42 extend beyond the translucent facing 77 of the sign 30 a clearance space (not shown) is provided between the corner sleeve members and the translucent facing which helps to assure the safety of the sign 30 during shipment. The insert members 32–42 also function as a shock absorbing deformable buffer between the corner sleeve members 22–28 amd the sign frame 80.

Another embodiment of my invention is shown by the development 144 in FIG. 11. The development 144 is a sheet pattern for use with an article, such as a sign having a smaller step portion than the step 89 of the sign 30.

The development 144 includes upper and lower edges 146, 148, and opposite side edges 140 and 152. Respective scorelines 154 and 156 extend across the opposite side edges 150 and 152. An intermediate cut portion 158 extends substantially perpendicular from the upper edge 146 to the scoreline 156, and a panel scoreline 160 extends from the cut portion 158 perpendicular to the lower edge 148.

A panel 162 of the development 144 is bounded by the upper edge 146, the cut portion 158, the panel scoreline 160, the lower edge 148 the the side edge 150. Another panel 164 is bounded by the upper edge 146, the side edge 152, the lower edge 148, the panel scoreline 160 and the cut portion 158. The scorelines 154, 156 define substantially equal foldable portions 166, 168 on the panel 162, and substantially equal foldable portions 170, 172 on the panel 164.

Although not shown the respective scorelines 154, 156 are slit on reverse surfaces of the development 144 to facilitate folding of the foldable portions 166, 168, 170 and 172 in a accordion fashion.

A tail portion 174 on the panel 162 is bounded by the scorelines 156, 160, the lower edge 148 and the side edge 150. Another wall portion 176 on the panel 164 is bounded by the scorelines 150, 156, the side edge 152 and the lower edge 148.

Figure 4:
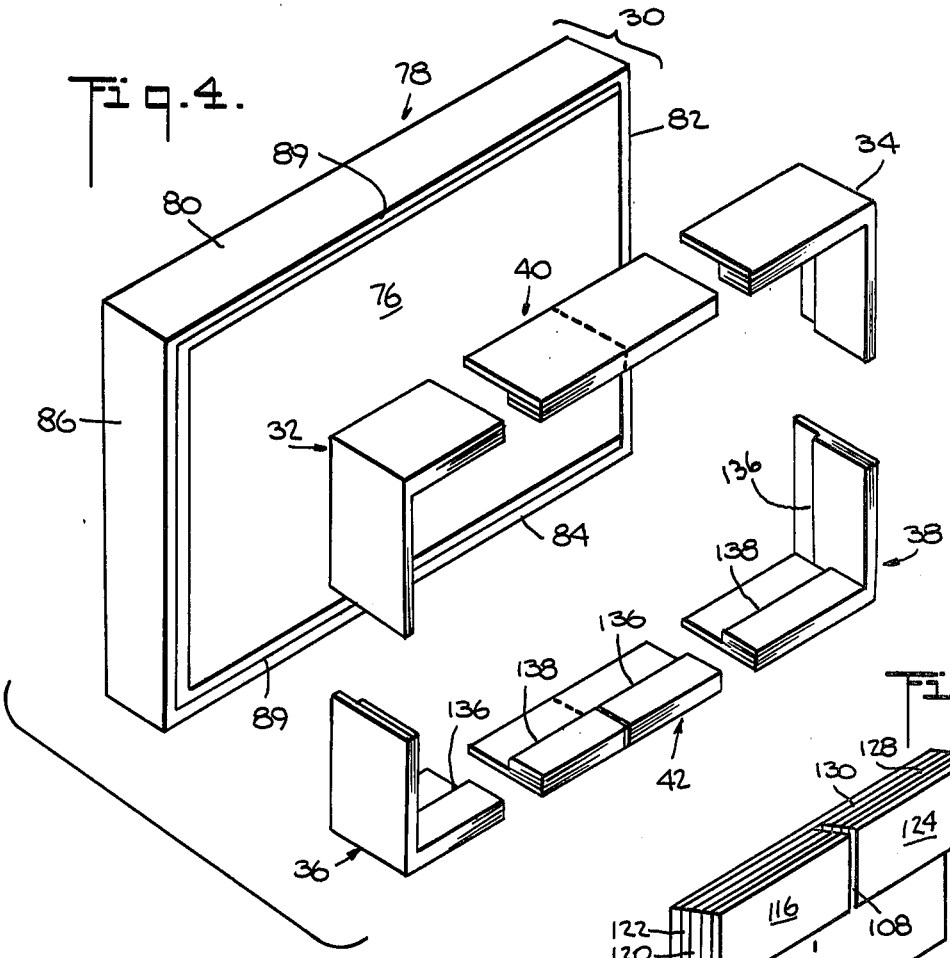
FIG. 4 is a perspective view of the inner packaging components exploded from the article being packaged.

The development 144 is folded to form the accordion configuration of FIG. 12, which is analogous to that of FIG. 6, by placing the foldable portions 166 and 170 against the foldable portions 168, 172. The foldable portions 168, 172 are then folded against the tail portions 174, 176 on the reverse surface of the development 144. In this manner step portions 178 and 180 are formed, which are smaller than the step portions 136 and 138 shown in FIG. 6. The resulting folded insert arrangement is analogous to the insert members 40 and 42 to FIGS. 3 and 4.

The FIG. 13 configuration, which is analogous to that of FIG. 8, is obtained by extending the foldable portions 166 and 168 over the tail portion 174 while the foldable portions 170 and 172 remain folded as shown in FIG. 12. The development 144 is then folded along the scoreline 160. The resulting arrangement is analogous to the insert members 32 and 38. The development 144 can also be folded to form the mirror image of the FIG. 13 arrangement yielding insert members analogous to the insert members 34 and 36 of FIGS. 2 and 4.

As will be apparent to those skilled in the art the corner sleeve members 22–28 can be assembled around the sign 30 in any selected sequence. For example the sleeve member 22 can be installed first, followed by the sleeve members 26, 28 and 24. It will also be apparent that the corner sleeve members can have any selected orientation. For example the corner sleeve member 22 can be installed with the side portion 70 confronting the frame side 80, and the side portions 64–66 confronting the frame side 86. In assembling the corner sleeve members it is optional to fold the side portion 64 inward of the side portion 66 since identical results are obtained if the side portion 66 is folded inward of the side portion 64.

Some advantages of the present invention evident from the foregoing description are insert members having a versatile application on either the straight side or the corner portion of a framed article having a step that is more pronounced on one of two intersecting frame sides. A further advantage is a corner sleeve arrangement that can be expanded or contracted to fit around articles of different size, within a given dimensional range. Still another advantage is a packaging arrangement incorporating corner sleeve members and insert members in combination to provide a safety clearance space between an enclosed article and an external wall of the package.

As various changes could be made in the above constructions without departing from the scope of the invention, it is intended that all matter contained in the above description or shown in The accompanying drawings shall be interpreted as illustrative and not in a limiting sense.

In view of the above it will be seen that the several objects of the invention are achieved and other advantageous results attained.

What is claimed is:

1. In combination with an article having a stepped peripheral side portion, a packaging insert comprising, a sheet of flexible foldable material of predetermined thickness having front and rear surfaces, opposite upper and lower edges and first and second side edges, a first, second, third and fourth score-line extending across said first and second side edges at respective predetermined spacings from said upper edge to form four equal first, second, third and fourth foldable portions, and a tail portion extending beyond said fourth scoreline to said lower edge, said insert being folded along said first, second, third and fourth scorelines in accordion fashion, to form a stepped away portion from said tail portion, the predetermined thickness of said insert being selected such that the stepped away portion of said insert substantially corresponds with and engages the stepped peripheral side portion of said article.

2. The insert of claim 1 wherein the first and third scorelines are slit on one of said surfaces of said sheet, the second and fourth scorelines being slit on the other said surface of said sheet to facilitate folding of said foldable portions.

3. The insert of claim 1 formed of corrugated material.

4. In combination with an article having a stepped peripheral edge portion, a packaging insert comprising, a sheet of flexible foldable material of predetermined thickness having front and rear surfaces, opposite upper and lower edges and first and second side edges, at least a first and second scoreline extendng across said first and second side edges at respective predetermined spacings from said upper edge to form two equal first and second, foldable portions and a tall portion extending beyond said second scoreline to said lower edge, said insert being folded along said first and second scorelines in accordion fashion to form a stepped away portion from said tail portion, the predetermined thickness of said insert being selected such that the stepped away portion of said insert substantially corresponds with and engages the stepped peripheral edge portion of said article.

5. A packaging insert as claimed in claim 4 wherein the first scoreline is slit on one of said surfaces of said sheet, the second scoreline being slit on the other said surface of said sheet to facilitate folding of said foldable portions.

6. A packaging insert as claimed in claim 4 formed of corrugated material.

7. A protective package for containing an article in the general shape of a rectangular parallelepiped having front and rear surfaces and four sides intersecting to form corner portions with corner angles at substantially 90°, at least two of the four sides having a stepped peripheral edge portion, said package comprising, at least two packaging inserts formed of a sheet of flexible foldable material having front and rear surfaces, opposite upper and lower edges and first and second side edges, a first, second, third and fourth scoreline extending across said first and second side edges at respective predetermined spacings from said upper edge to form four equal first, second, third and fourth foldable portions, and a tail portion extending beyond said fourth scoreline to said lower edge, said two inserts being folded along said first, second, third and fourth scorelines in accordion fashion to form a stepped away portion from said tail portion, the stepped away portions in each of said two inserts engaging the respective stepped peripheral edge portions of said article, a corner sleeve member engageable with each of the corner portions of said article each said corner sleeve member comprising two side portions intersecting at an angle substantially equivalent to the respective corner portion angle of said article, spaced and oppositely disposed web portions corresponding to the front and rear surfaces of said article extending substantially perpendicularly from said side portions, each said web portion having a free edge portion defining an opening for receiving said article in said corner sleeve, the spacing between said web portions being greater than the distance between the front and rear surfaces of said article to permit accommodation of said two inserts and said article in the article receiving opening of said corner sleeve, the respective spacing between web portions on said respective corner sleeve members and the extent of said web portions and said side portions being predetermined to permit overlapping the corresponding web portions and side portions of said respective corner sleeve members when said respective corner sleeve members accommodate respective corner portions of said article.

8. A package as claimed in claim 7 wherein the web portions and the side portions of each respective corner sleeve member overlap to totally enclose said article.

9. A package as claimed in claim 7 wherein said corner sleeve members and said inserts are formed of corrugated material.

10. A package as claimed in claim 1 wherein said first and third scorelines of said insert are slit on one of the surfaces of said sheet, the second and fourth scorelines being slit on the other said surface of said sheet to facilitate folding of said foldable portions.

11. A package as claimed in claim 16 further including an additional number of said inserts corresponding to the number of corner portions of said article, said additional number of inserts including a cut portion intermediate said first and second side edges extending substantially perpendicular from said upper edge to said third fold-line and a panel scoreline extending from said cut portion to said opposite lower edge substantially perpendicular to said opposite lower edge such that said cut portion and said panel scoreline divide said sheet into two panels, said additional number of inserts beng folded along said fourth fold line, one of the panels in each of said additional number of inserts being further folded in accordion fashion along said first, second and third fold lines to form said stepped away portion, and the other said panel being further folded along the second scoreline such that said first and second foldable portions lie in substantially one plane and the third and fourth foldable portions lie in substantially another plane over the first and second foldable portions, each of said additional number of inserts being folded along said panel scoreline to place the tall portion of each said panel in substantially perpendicular relationship, and wherein each of said additional number of inserts engage a respective said corner portion of said article prior to disposition of said corner sleeve members on said article, such that said stepped away portions of each of said additional number of inserts engages respective stepped peripheral edge portions of said article at respective corner portions of said article, the other said folded panel of each of said additional number of inserts being arranged to confront the respective other two sides of said article.

12. A packaging insert for an article having a stepped peripheral side portion, comprising, a sheet of flexible foldable material having front and rear surfaces, opposite upper and lower edges and first and second side edges, a first, second, third and fourth scoreline extending across said first and second side edges at respective predetermined spacings from said upper edge to form four equal first, second, third and fourth foldable portions, and a tall portion extending beyond said fourth scoreline to said lower edge, a cut portion intermediate said first and second side edges extending substantially perpendicularly from said upper edge to said third fold-line and a panel scoreline extending from said cut portion to said opposite lower edge substantially prependicular to said opposite lower edge such that said cut portion and said panel scoreline divide said sheet into two panels, said cut portion permitting independent folding of the first, second and third foldable portions in each said panel along the first, second and third fold-lines, and wherein both panels of said sheet are folded along said fourth fold line, one of said panels being further folded in accordion fashion along said first, second and third fold lines, and the other said panel being further folded along the second scoreline such that said first and second foldable portions lie in substantially one plane and the third and fourth foldable portions lie in substantially another plane over the first and second foldable portions, said sheet being folded along said panel scoreline to place the tail portion of each said panel in substantially perpendicular relationship.

13. The insert of claim 12 wherein the first and third scorelines are slit on one of said surfaces of said sheet, the second and fourth scorelines being slit on the other said surface of said sheet to facilitate folding of said foldable portions.

14. The insert of claim 12 formed of corrugated material.

15. A packaging insert for an article having a stepped peripheral edge portion, comprising, a sheet of flexible foldable material having front and rear surfaces, opposite upper and lower edges and first and second side edges, at least a first and second scoreline extending across said first and second side edges at respective predetermined spacings from said upper edge to form two equal first and second, foldable portions and a tail portion extending beyond said second scoreline to said lower edge, a cut portion intermediate said first and second side edges extending substantially perpendicular from said upper edge to at least said second fold line and a panel scoreline extending from said cut portion to said opposite lower edge substantially perpendicular to said opposite lower edge such that said cut portion and said panel scoreline divide said sheet into two panels, said cut portion permitting independent folding of the first and second foldable portions in each panel along the first and second fold-lines, and wherein both panels of said sheet are folded along said second fold-line, one of said panels being further folded in accordion fashion along said first fold-line, and the first and second foldable portions of the other said panel lie in substantially the same plane over the tail portion of the other said panel, said sheet being folded along said panel score-line to place the tail portion of each said panel in substantially perpendicular relationship.

16. A packaging insert as claimed in claim 15 wherein the first scoreline is slit on one of said surfaces of said sheet, the second scoreline being slit on the other said surface of said sheet to facilitate folding of said foldable portions.

17. A packaging insert as claimed in claim 15 formed of corrugated material.

* * * * *

UNITED STATES PATENT AND TRADEMARK OFFICE

CERTIFICATE OF CORRECTION

PATENT NO. : 4,162,729

DATED : July 31, 1979

INVENTOR(S) : Louis Kaiser and Charles J. Pascal

It is certified that error appears in the above-identified patent and that said Letters Patent are hereby corrected as shown below:

Column 7, line 26, the word "tall" should read --tail--.

Column 8, line 11 after "overlapping" insert --of--.

Column 8, line 21, the number "1" should read --7--.

Column 8, line 26, the number "16" should read --7--.

Column 8, line 36, the word "beng" should read --being--.

Column 8, line 67, the word "tall" should read --tail--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*